United States Patent [19]

Puech

[11] Patent Number: 4,577,581

[45] Date of Patent: Mar. 25, 1986

[54] ANCHORING DEVICE

[75] Inventor: Alain Puech, Rueil-Malmaison, France

[73] Assignee: Societe Nouvelle Construction Metalliques de Provence, Paris La Defense, France

[21] Appl. No.: 536,159

[22] PCT Filed: Jan. 4, 1983

[86] PCT No.: PCT/FR83/00002

§ 371 Date: Aug. 31, 1983

§ 102(e) Date: Aug. 31, 1983

[87] PCT Pub. No.: WO83/02432

PCT Pub. Date: Jul. 21, 1983

[30] Foreign Application Priority Data

Jan. 5, 1982 [FR] France ..... 82 00043

[51] Int. Cl.[4] ..... B63B 21/34

[52] U.S. Cl. ..... 114/294; 114/301

[58] Field of Search ..... 114/294, 301; 405/224

[56] References Cited

U.S. PATENT DOCUMENTS

| | | | |
|---|---|---|---|
| 2,738,750 | 3/1956 | Vorenkamp | 114/301 |
| 4,173,938 | 11/1979 | Colin | 114/294 |

FOREIGN PATENT DOCUMENTS

| | | |
|---|---|---|
| 0024221 | 2/1981 | European Pat. Off. . |
| 2082722 | 12/1971 | France . |
| 2366987 | 5/1978 | France . |
| 7414536 | 5/1976 | Netherlands . |

*Primary Examiner*—Sherman D. Basinger

*Attorney, Agent, or Firm*—Millen & White

[57] ABSTRACT

An anchoring device according to the invention, for a floating installation, to which the device is attached by an anchoring line. The device comprises at least two anchors of plowshare type (1 and 2), disposed side by side and attached by crossmembers (4 and 5) to rigid shanks (6 and 7) and an anchoring plate (12) attached to the free ends of the shanks (6 and 7). The use of the device is in the anchoring over long periods of time of floating installations such as floating installations of drilling, of production, barges, pontoons, buoys, and other such installations.

23 Claims, 6 Drawing Figures

ANCHORING DEVICE

BACKGROUND OF THE INVENTION

The present invention concerns an anchoring device capable of maintaining beneath a determined site, and for long periods of time, a floating installation on the surface of the water, such as a petroleum production floating installation, a barge, a floating landing stage, a charging/discharging buoy, etc. . . .

The anchors with which the floating installation is connected by anchoring lines constitute one of the means for maintaining in position the floating installation. The actual tendency at present being to employ floating installations of dimensions which are larger and larger, it has become necessary to deploy anchoring devices which are more and more powerful, capable of opposing forces applied onto the floating installation and due essentially to the action of the wind, the waves, the swell, the marine currents, etc. . . .

One of the means for augmenting the power of the anchorage consists of utilizing anchors of dimensions and masses which are quite large. This solution is not entirely satisfactory. It is known in effect that the efficiency of anchors does not increase proportionally to their mass, with the result that the obtaining of very high capacities points in the direction of making anchors which are excessively heavy and difficult to handle.

Another means of augmenting the anchoring power is to adopt an anchor structure favorable to the penetration and the burying of the anchor in the sea floor. The solutions of this type are described in French Pat. Nos. 2,366,987 and 2,082,722, Netherlands Pat. No. 7,414,536, European Pat. No. 24,221 and German Pat. No. 242,975.

SUMMARY OF THE INVENTION

The present invention proposes an anchoring device having a particular structure which favors the penetration of the anchoring device into the bottom, which confers in this manner an anchoring power superior to that of the anchors or anchor systems of identical weight, utilized up to now.

The anchoring device of a floating installation to which the device is connected by an anchoring line, comprises an assembly of at least two anchors which are substantially identical with each other at an anterior part and being of a form facilitating the penetration into the bottom and fixed, at the posterior portion, to an end of a rigid shank by a means of a rigid crossmember, an anchoring plate having teeth or serrations eventually connecting the rigid shanks between themselves, and means for connecting the anchoring line at the free ends of said shanks.

The assembly of anchors is constituted by anchors of plowshare type having a dihedral shape and disposed in a manner such that the plane passing through the free ends of the shanks defines with the axis of each shank an angle $\beta$ comprising between 15° and 35°.

Preferably, the ratio of the surface of the anchoring plate to the sum of the surfaces of the plowshare anchors projecting on a plane parallel to the anchoring plate is comprised between 0.50 and 1, and preferably about 0.75.

According to a particular mode of realization, the upper edges of the dihedrons are substantially parallel to the anchoring plate and make with the axis of the shanks an angle $\alpha$ comprising between 10° and 30° and preferably about 18°. In addition, the length L of the shanks is greater than 1.5 times the length A of the upper edges of the dihedrons and preferably said length is comprised of between 2 and 3 times the length of the upper edges.

These characterizing differences can be employed separately or in combination.

BRIEF DESCRIPTION OF THE DRAWINGS

The present invention can be well understood and all of its advantages clearly apparent from a reading of the description which follows, illustrated by the figures attached hereto.

DETAILED DESCRIPTION OF THE INVENTION

Figure 1:
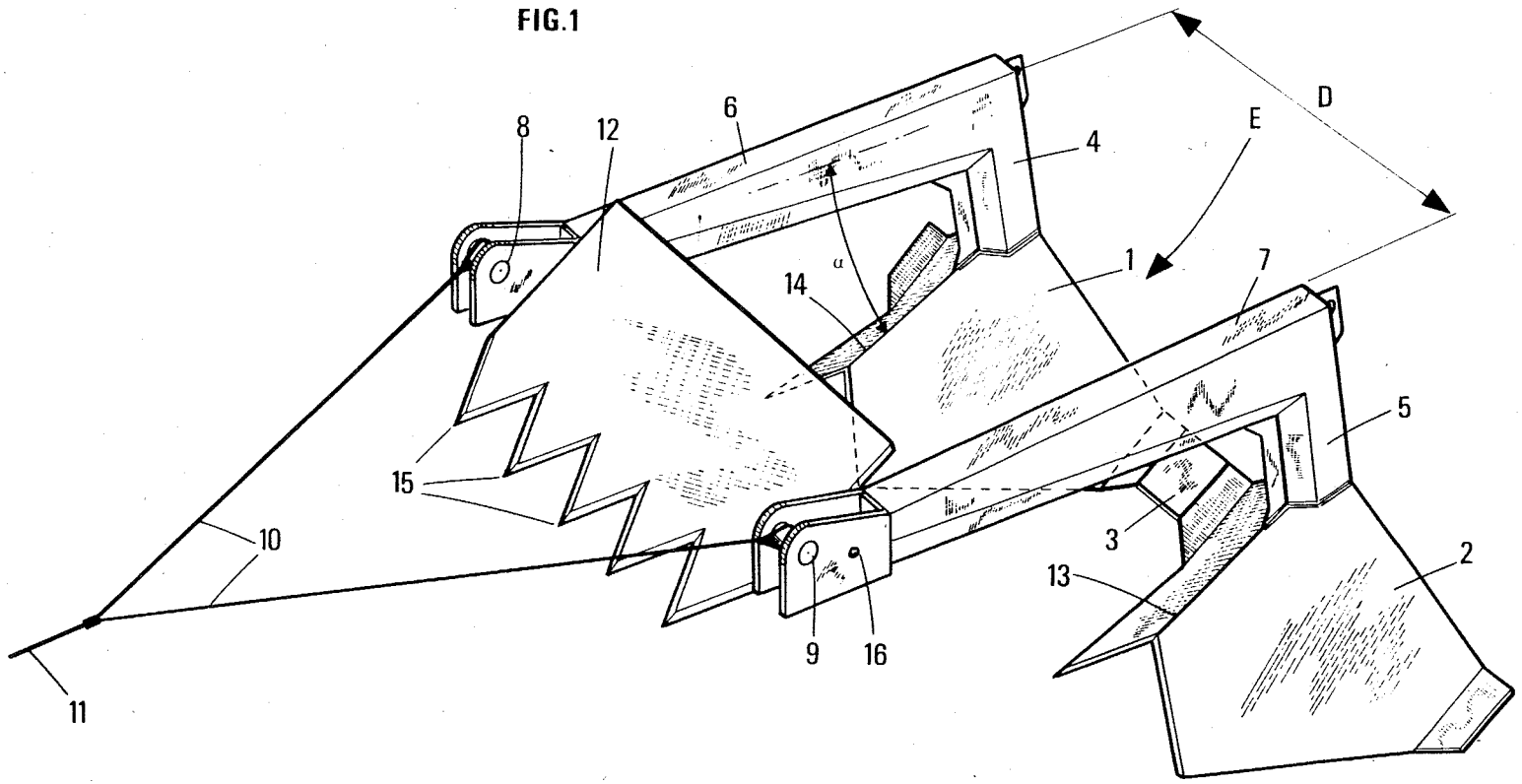
FIG. 1 is a perspective view of one mode of realization of the invention.

The FIG. 1 represents, in a perspective view, a mode of realization of the invention which is established to have a great anchoring power on ocean bottoms of different natures, such as sand, silts, and clays of highly variable compactness and consistencies.

The device comprises essentially an assembly of two anchors of plowshare type 1 and 2, disposed side by side and attached by a connecting piece 3 providing the existence between them of a free space E.

Each of said anchors has an anterior portion of a shape facilitating penetration into the bottom and a posterior portion attached by a crossmember or strut (crossmembers or struts 4 and 5 respectively) to an extremity of a shank or rigid arm (shanks 6 and 7 respectively). At their free ends, the shanks 6 and 7 are provided with orifices 8 and 9 permitting their connection to a traction line 10, in the shape of a V or "goose foot", to which is attached in a known manner the anchoring line 11 connected to the floating installation (not shown).

An anchoring plate 12 is disposed between the shank 6 and 7, in a manner that the plane of symmetry of the anchoring plate is substantially blended with the plane of symmetry of the assembly of plowshare anchors 1 and 2.

Said anchoring plate is attached on the shanks at a distance B from the crossmembers (FIG. 2) which will be defined hereinafter.

Figure 2:
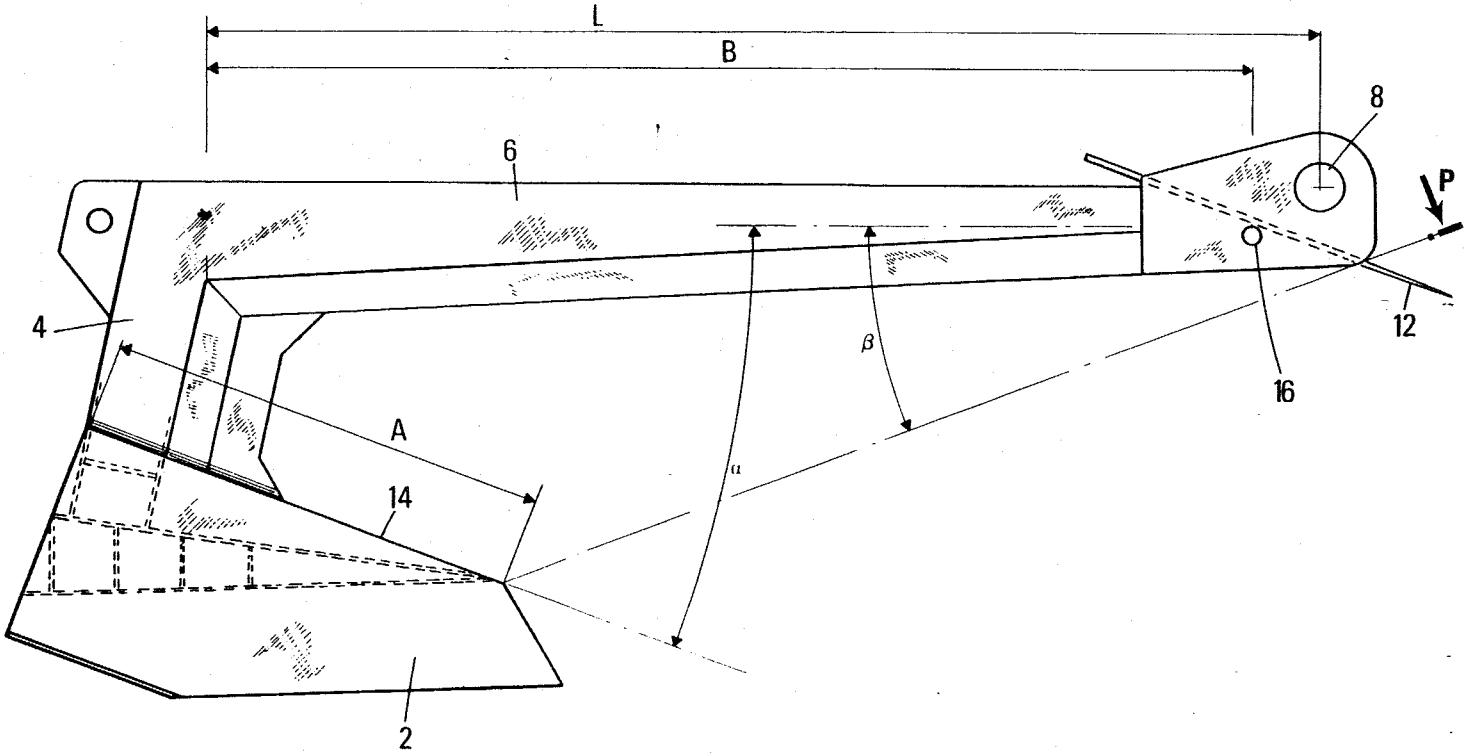
FIG. 2 is a side view of the device of FIG. 1.
Figure 3:
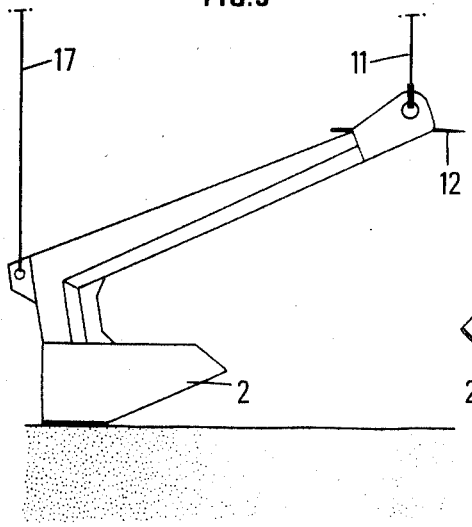
FIGS. 3 to 6 illustrate schematically the method of implementing the device according to the invention.

The FIG. 2 represents a side view of the device according to the invention.

Each plowshare anchor such as 2 presents the general shape of a dihedron and have two plates whose intersection constitutes the upper edge of the dihedron. Said edge has a length A.

The plowshare anchors and the shanks with which they are associated are disposed in a manner such that the plane P which passes substantially by the free ends of the shanks 6 and 7 and through the anterior ends of the upper edges 13 and 14 of the plowshare anchors 2 (FIG. 1) form with the axes of the shanks an angle $\beta$ comprising between 15° and 35° and preferably about 20° (the plane P is represented by a mixed line in FIG. 2).

In addition, the angle $\alpha$ between the upper edge of a dihedron and the axis of the shank corresponding thereto comprises between 10° and 30° and preferably about 18°.

The length L of the shanks is greater than the length A of the upper edges of the dihedrons making up the plowshare anchors. Good results are obtained when the length L is greater than 1.5A and preferably comprising between 2A and 3A.

The space E is such that the distance D between the top edges of adjacent plowshares is comprised between 1.5A and 2.5A, and preferably about 2A.

The distance B defining the position of the anchoring plate 12 on the shanks is comprised between 1A and 3A and preferably about 2.5A.

The anchoring plate 12 which is also a flat plate is advantageously furnished at its lower part with teeth 15 (FIG. 1) for the purpose of facilitating penetration of the plate into the ground as will be described hereinafter.

The plate 12 is attached on the shanks 6 and 7 by an axle which permits the adjustment of its inclination in relation to the shanks 6 and 7, securing means, not shown, assures the immobilization of the plate 12 with reference to the shanks 6 and 7.

Said anchoring plate 12 is disposed in a manner such that the upper surface is substantially parallel to the upper edges 13 and 14 of the dihedrons making up the plowshare anchors 1 and 2.

The surface $S_p$ of said anchoring plate is chosen such that the value of the ratio $$R = \frac{S_p}{\Sigma S_s}$$

is comprised between 0.50 and 1 and preferably about 0.75, $\Sigma S_s$ being the sum of the projections of the surfaces of the plates when constituting the dihedrons, over the plane of the anchoring plate 12.

Modifications can be made to the device without departing from the scope of the present invention.

In particular, it is possible to provide an assembly comprising more than two plowshare anchors disposed side by side, the ends of the anchors at least being associated at the shanks as indicated above, and the anchoring plate 12 connecting all the shanks.

It is equally possible to provide plural stiffeners between the shanks and/or the crossmembers.

The plowshare anchors can also equally be of a known type, such as the type for example illustrated in FIGS. 1 to 5 of U.S. Pat. No. 4,173,938.

Figure 6:
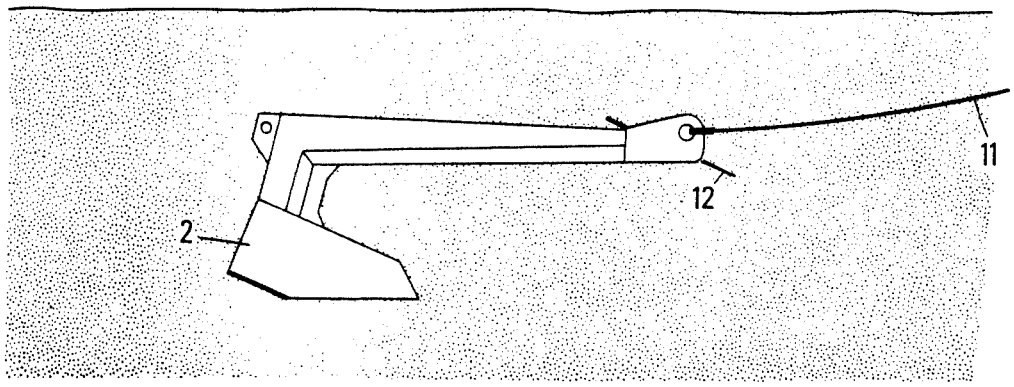

Equally the anchor plate 12 can be made up of a plate in the shape of a portion of a cylinder with the concavity being oriented toward the free ends of the shanks, or toward the anchors 1 and 2. In a general manner said anchoring plate can be of a type known, such as illustrated for example, in FIGS. 6 and 7 of U.S. Pat. No. 4,173,938. Eventually, said plate will comprise a network of stiffeners on the lower face.

The FIGS. 3–6 illustrate schematically the placing in operation of the device according to the invention.

Figure 4:
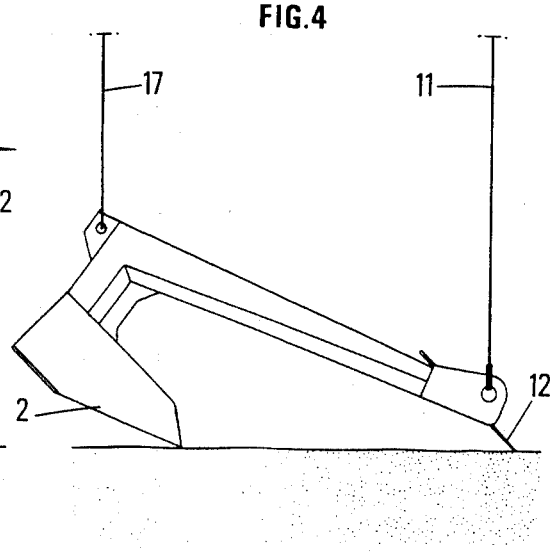
Figure 5:
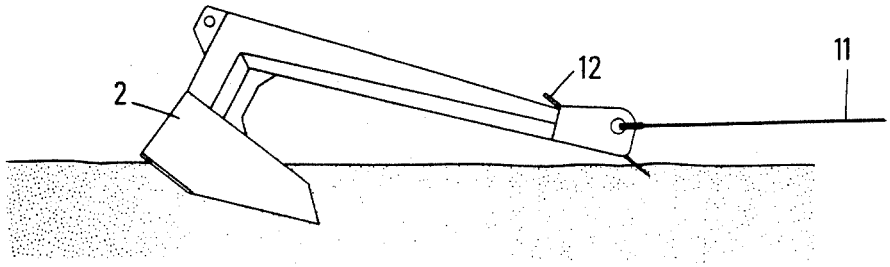

The anchoring device attached at the end of the anchoring line 11 and suspended by a control cable 17, is lowered to the bottom of the water (FIG. 3) and then deposited on the bottom in an operative position (FIG. 4). The maneuvering cable 17 is retired. A traction which is essentially horizontal is exerted on the anchor by means of the anchoring line 11. One observes as a result that there is a penetration of the anchors into the ground (FIG. 5) which is effected by successive burials in an alternating manner of the plowshare anchors and of the anchoring plate until there is obtained a maximum burial of the device (FIG. 6) which assures the maximum anchoring power.

The construction of such an anchoring device can be effected by mechanical welding of principally sheets of iron.

I claim:

1. An anchoring device for a floating installation to which the device is connected by an anchoring line, the device comprising:

an assembly of at least two plowshare anchors wherein each anchor includes an interior part of a shape facilitating penetration into ground and a posterior part, each anchor including a dihedron having an upper edge with a front portion;

at least two rigid shanks having an axis and first and second ends, each shank being connected at its first end to one of the dihedrons by a rigid strut extending upwardly from a location adjacent to both the upper edge and the posterior of the dihedron, the shanks being disposed in an orientation wherein the plane passing through the front portion of each upper edge of the dihedrons and the second end of the shanks define with the axis of each shank an angle in the range of about 15° to about 35°;

an anchoring plate rigidly fixed to the shanks and extending therebetween at a location adjacent to the second ends of the shanks; the anchoring plate having a pair of exposed, parallel surfaces which are substantially parallel to the upper edges of the dihedrons, and the anchoring plate having a leading edge defined by a plurality of teeth, and means disposed at both ends of each shank for attaching anchor lines.

2. A device according to claim 1, wherein the ratio of the surface of the anchoring plate to the sum of the surfaces of the plowshare anchors projecting on a plane parallel to the anchoring plate is comprised between 0.50 and 1.

3. A device according to claim 2, wherein the upper edges of said dihedrons define with the axis of the shanks an angle comprising between 10° and 30°.

4. A device according to claim 3, wherein the length of the shanks is greater than 1.5 times the length of the upper edges of the dihedrons.

5. A device according to claim 4, wherein said anchoring plate is attached on the shanks at a distance from the struts at least equal to 1 time the length of the upper edges of the dihedrons.

6. A device according to claim 3, wherein said anchoring plate is attached on the shanks at a distance from the struts at least equal to 1 time the length of the upper edges of the dihedrons.

7. A device according to claim 2, wherein the length of the shanks is greater than 1.5 times the length of the upper edges of the dihedrons.

8. A device according to claim 7, wherein said anchoring plate is attached to the shanks at a distance from the struts at least equal to 1 time the length of the upper edges of the dihedrons.

9. A device according to claim 2, wherein said anchoring plate is attached to the shanks at a distance from the struts at least equal to one time the length of the upper edges of the dihedrons.

10. A device according to claim 2, wherein the ratio of the surface of the anchoring plate to the sum of the surfaces of the plowshare anchors projecting on a plane parallel to the anchoring plate is about 0.75.

11. A device according to claim 1, wherein the upper edges of said dihedrons define with the axes of the shanks an angle comprising between 10° and 30°.

12. A device according to claim 11, wherein the length of the shanks is greater than 1.5 times the length of the upper edges of the dihedrons.

13. A device according to claim 12, wherein said anchoring plate is attached on the shanks at a distance from the struts at least equal to 1 time the length of the upper edges of the dihedrons.

14. A device according to claim 11, wherein said anchoring plate is attached to the shanks at a distance from the struts at least equal to 1 time the length of the upper edges of the dihedrons.

15. A device according to claim 11 wherein the upper edges of said dihedrons form with the axis of the shanks an angle of about 18°.

16. A device according to claim 1, wherein the length of the shanks is greater than 1.5 times the length of the upper edges of the dihedrons.

17. A device according to claim 16, wherein said anchoring plate is attached to the shanks at a distance from the struts at least equal to 1 time the length of the upper edges of the dihedrons.

18. A device according to claim 16, wherein the length of the shanks is comprised between two and three times the length of the upper edges of the dihedrons.

19. A device according to claifm 1, wherein said anchoring plate is attached to the shanks at a distance from the struts at least equal to 1 times the length of the upper edges of the dihedrons.

20. A device according to claim 19, wherein said anchoring plate is attached to the shanks at a distance from the struts comprising between 2 and 3 times the length of the upper edges of the dihedrons.

21. A device according to claim 1, wherein the angle formed between each shank and the plane passing through the second ends of the shanks through the front ends of the edges of the dihedrons is about 20°.

22. A device according to claim 1, wherein the distance between the upper edges of the dihedrons is comprised between 1.5 and 2.5 times the length of the upper edges of the dihedrons.

23. A device according to claim 22, wherein the distance between the upper edges of the dihedrons is about 2 times the length of the upper edges of said dihedrons.

* * * * *